US006447307B1

(12) United States Patent
Wu

(10) Patent No.: US 6,447,307 B1
(45) Date of Patent: Sep. 10, 2002

(54) ELECTRICAL CONNECTOR HAVING SPACER

(75) Inventor: Jerry Wu, Pan-Chiao (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/904,369

(22) Filed: Jul. 11, 2001

(51) Int. Cl.[7] ..... H01R 12/20
(52) U.S. Cl. ..... 439/79
(58) Field of Search ..... 439/79, 381

(56) References Cited

U.S. PATENT DOCUMENTS 5,658,155 A * 8/1997 McFarlane et al. ..... 439/79
5,971,774 A * 10/1999 Kuki et al. ..... 439/79
6,065,979 A * 5/2000 Lai et al. ..... 439/79
6,093,033 A * 7/2000 Kuki et al. ..... 439/79
6,273,732 B1 * 8/2001 Johnescu et al. ..... 439/79

* cited by examiner

*Primary Examiner*—Gary F. Paumen
(74) *Attorney, Agent, or Firm*—Wei Te Chung

(57) ABSTRACT

An electrical connector (1) includes an insulative housing (10), a number of electrical contacts (20) mounted in the insulative housing and a dielectric spacer (30). The insulative housing includes a mating portion (14) and a mounting portion (12). The mounting portion has a pair of arms (120) each having a step portion (122), a cutout (124), a number of recesses (126) recessed from a bottom surface thereof, and a number of blocks (128) beside the recesses. The dielectric spacer includes a plate body (31)and a pair of latches (32) extending upwardly from the plate body. The plate body includes a number of retainers (34) engaging with the recesses and the blocks of the mounting portion and a pair of extensions (36) extending into the cutouts of the arms. Each latch has an outward hook section (33) mating with the step portion of the arm.

1 Claim, 7 Drawing Sheets

ELECTRICAL CONNECTOR HAVING SPACER

BACKGROUND OF THE INVENTION

1. Field of the Invention

The present invention relates to an electrical connector, and particularly to an electrical connector having a spacer assembled to an insulative housing thereof.

2. Description of the Related Art

Electrical connectors are being made more and more light, thin, short and small in order to comply with the trend toward miniaturization of the electronic device in the electronic field and related components of the electrical connectors are in turn made more and more light, thin, short and small as a result. On the other hand, numbers of electrical contacts of each electrical connector are increased to meet the present high speed, large quantity and broad bandwidth signal transmission requirements in the electronic field.

In, such a situation, the pitch between every two adjacent electrical contacts of an electrical connector is considerably reduced and cause many problems in manufacturing and assembling processes thereof. A dielectric spacer is sometimes provided to. aid in retaining the high-densely arranged electrical contacts and to align exactly the electrical contacts to solder pads (in case of surface mounting technology being used) or through holes (where through hole technology is utilized) on a printed circuit board to which the electrical connector is mounted.

The dielectric spacer is usually assembled to an insulative housing of the electrical connector. However, the conventional dielectric spacer is apt to displace with respect to an insulative housing of the electrical connector and is possibly to fall out of its retention to the insulative housing, which is obviously undesired in view of the signal transmission quality of the electrical connector.

Therefore, an electrical connector having an improved dielectric spacer is desired to overcome the disadvantages of the prior art.

SUMMARY OF THE INVENTION

A major object of the present invention is to provide anelectrical connector having a dielectric spacer reliably assembled to an insulative housing thereof.

An electrical connector in accordance with the present invention comprises an insulative housing, a plurality of electrical contacts mounted in the insulative housing and a dielectric spacer. The insulative housing comprises a mounting portion and a mating portion projecting forwardly from the mounting portion. The mounting portion has a pair of opposite arms extending rearwardly at two opposite ends thereof and three recesses recessed from a bottom surface of a rear end thereof. A pair of blocks protrude downwardly from the bottom surface beside two opposite sides of a rear portion of each recess. Each arm comprises a step portion in an inward face thereof and a cutout at a rear and lower end thereof.

The dielectric spacer comprises a generally flat plate body and a pair of latches extending upwardly from front portions of opposite ends of the plate body. The plate body comprises a plurality of through holes defined therein for mounting portions of the electrical contacts extending therethrough and retained thereby, three retainers protruding from a front end thereof to be partially pressed into the recesses and retained by the blocks, and a pair of extensions extending laterally and outwardly at rear portions of the opposite ends thereof to extend into the cutouts of the arms. Each latch has an outward hook section at an upper end thereof to engage with the step portion of the arm.

Other objects, advantages and novel features of the invention will become more apparent from the following detailed description of the present embodiment when taken in conjunction with the accompanying drawings.

DETAILED DESCRIPTION OF THE INVENTION

Figure 1:
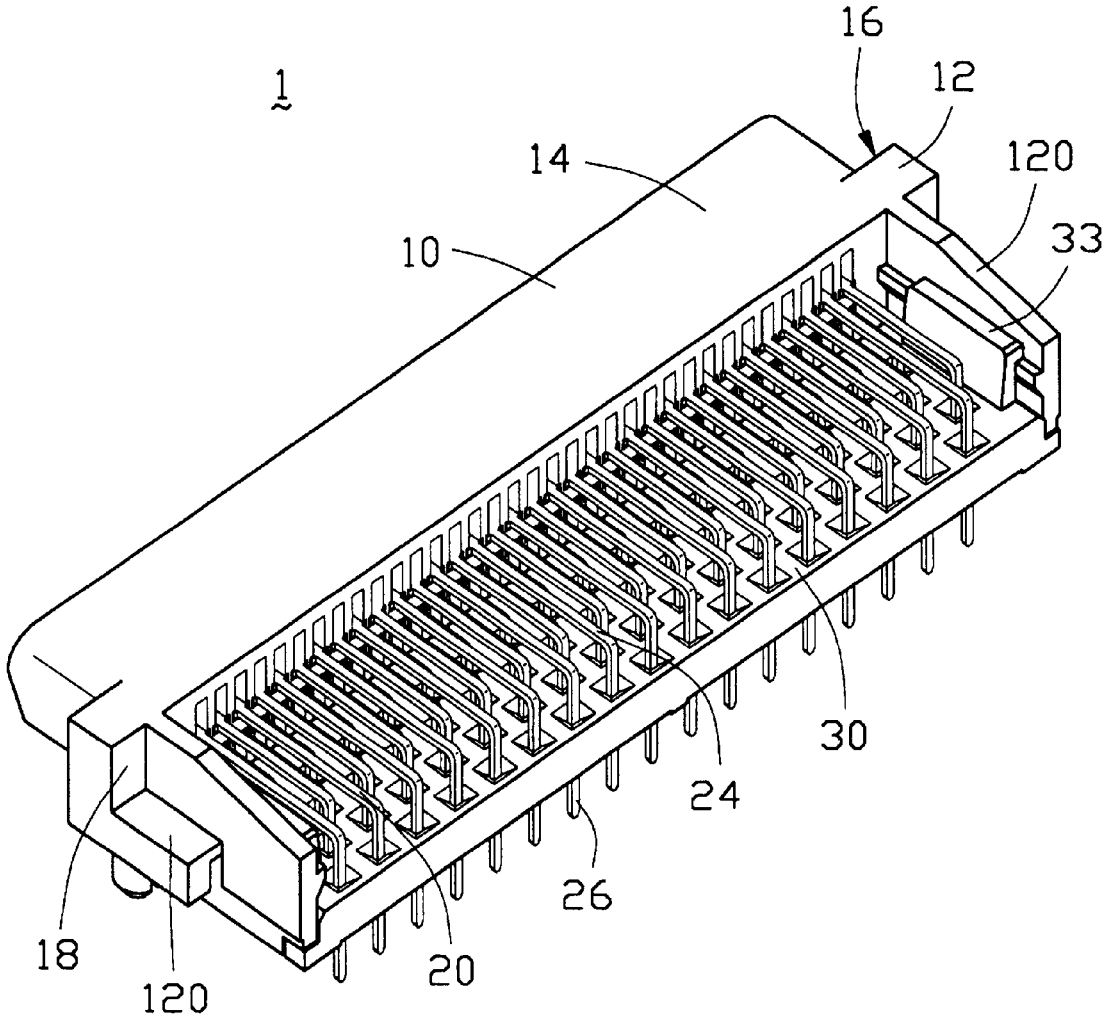
FIG. 1 is a perspective view of an electrical connector in accordance with the present invention.
Figure 2:
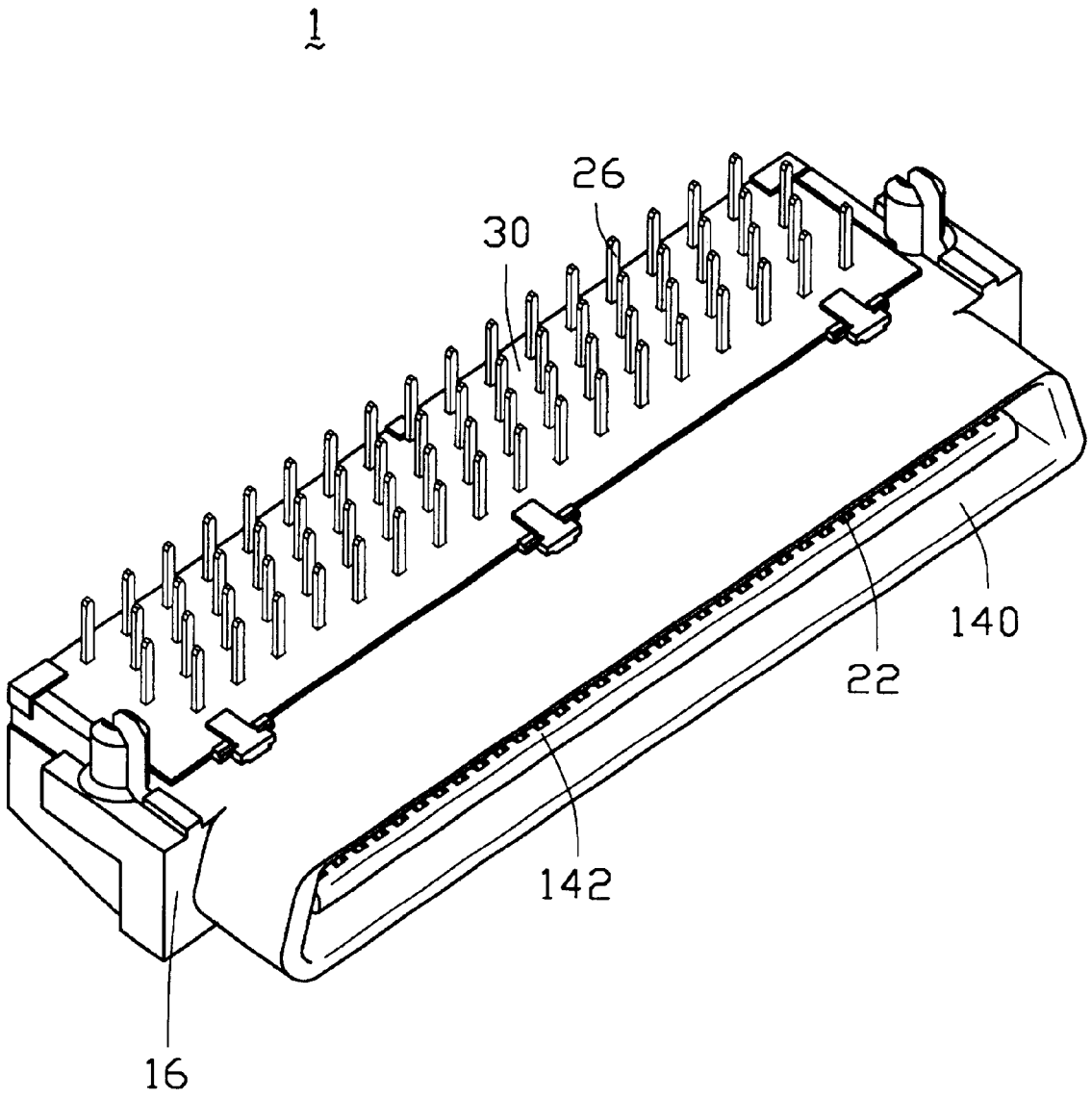
FIG. 2 is a perspective view of the inverted electrical connector in FIG. 1.

Referring to FIGS. 1 and 2, an electrical connector 1 in accordance with the present invention comprises an insulative housing 10, a plurality of electrical contacts 20 and a dielectric spacer 30. Each electrical contact 20 comprises a contacting portion 22, a transitional portion 24 and a mounting portion 26. The mounting portions 26 are generally perpendicular to the contacting and transitional portions 22, 24.

The insulative housing 10 comprises a mounting portion 12 defining a front surface 16 and a rear surface 18 opposite to the front surface 16, and a mating portion 14 projecting forwardly from the front surface 16 of the mounting portion 12. The mating portion 14 comprises a receiving cavity 140 open to a front end thereof and a tongue 142 extending in the receiving cavity 140. The tongue 142 defines a plurality of passageways 144 (FIG. 6) extending in an upper and a lower surfaces thereof and through the rear surface 18 of the mounting portion 12.

Figure 4:
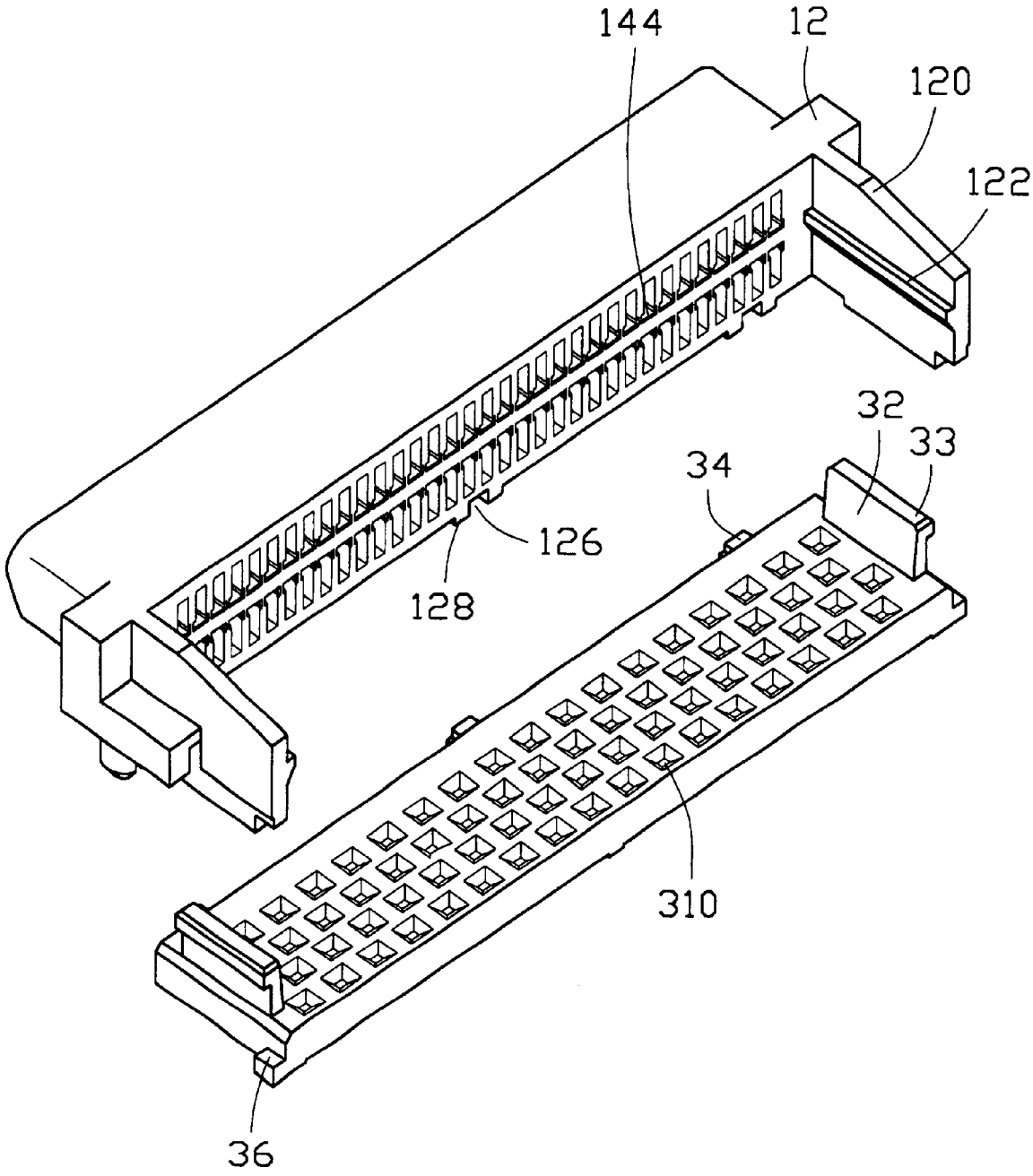
FIG. 4 is an exploded view of FIG. 3.
Figure 6:
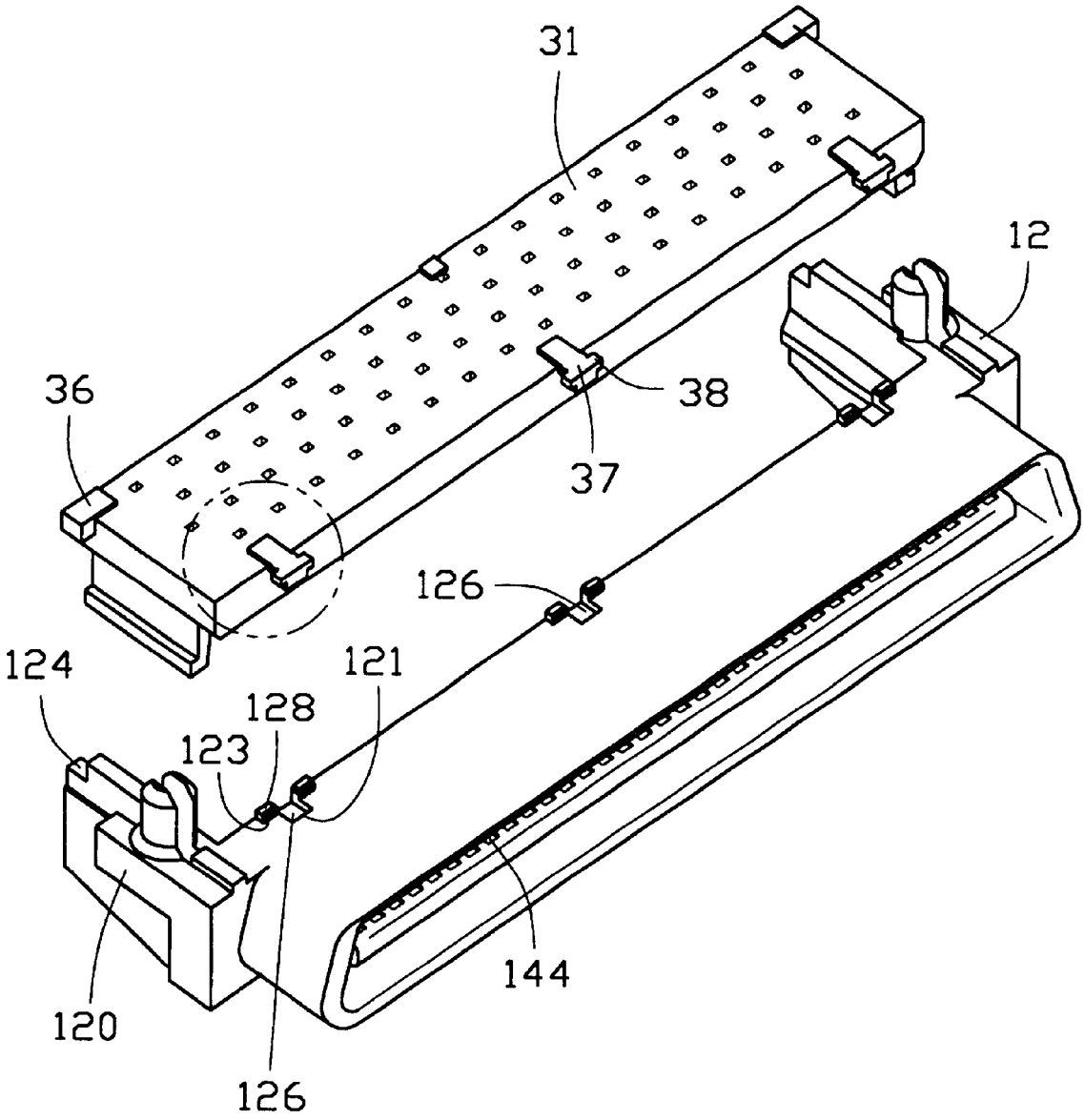
FIG. 6 is an exploded view of FIG. 5.
Figure 7:
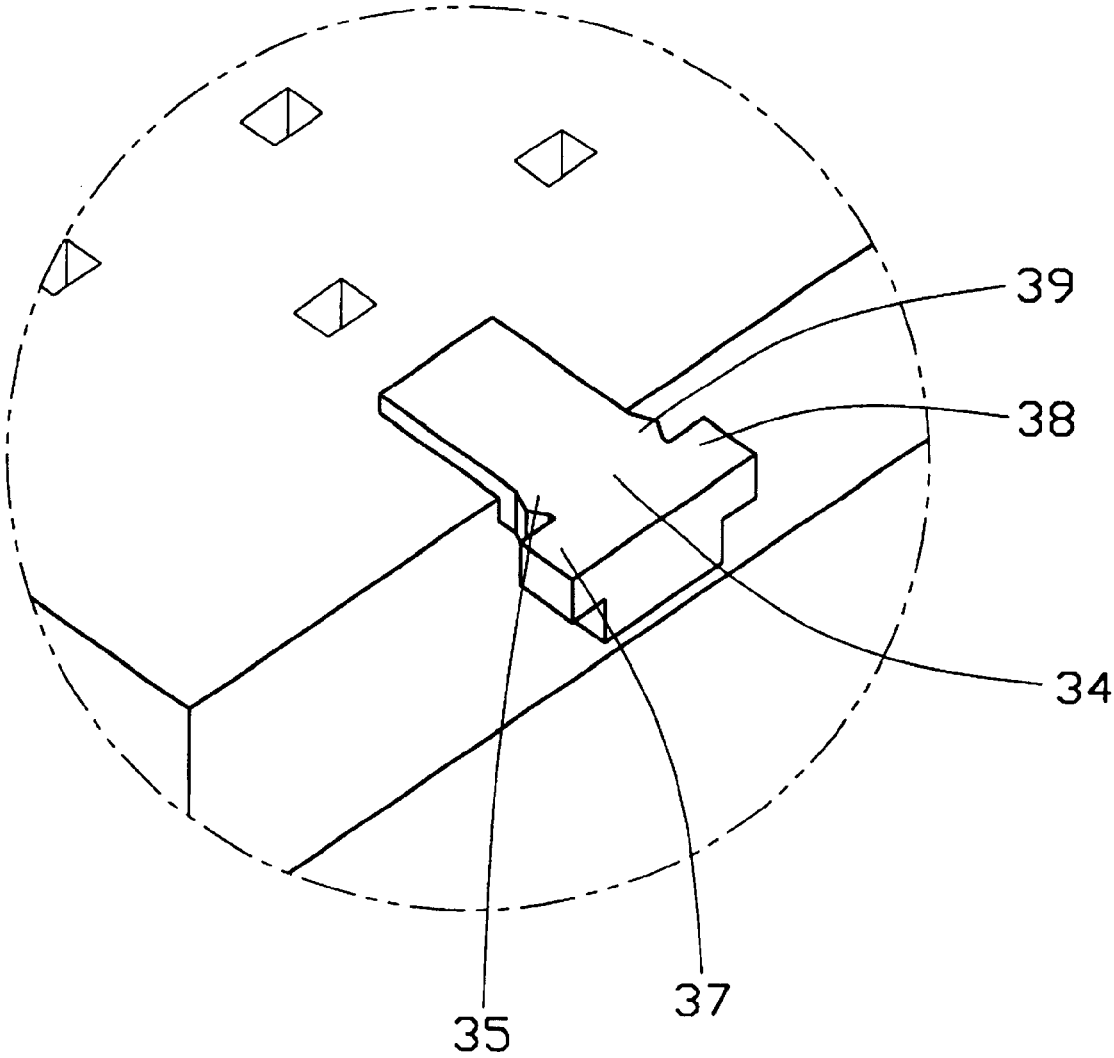
FIG. 7 is a partially enlarged view taken from FIG. 6.

Referring also to FIGS. 4, 6 and 7, the mounting portion 12 comprises a pair of opposite arms 120 extending rearwardly from the rear surface 18 of opposite longitudinal ends thereof. Each arm 120 comprises a step portion 122 in an inward surface thereof and a cutout 124 at a lower and rear end thereof. The mounting portion 12 further comprises three recesses 126 recessed from a bottom surface of a rear end thereof and a pair of blocks 128 protruding downwardly from the bottom surface beside rear portions of two opposite sides of each recess 126. As is clearly shown in FIG. 7, the recesses 126 extend forwardly more than corresponding blocks 128 extend, i.e., forward edges 123 of the blocks 128 are located rearward of forward edges 121 of the recesses 126.

Figure 3:
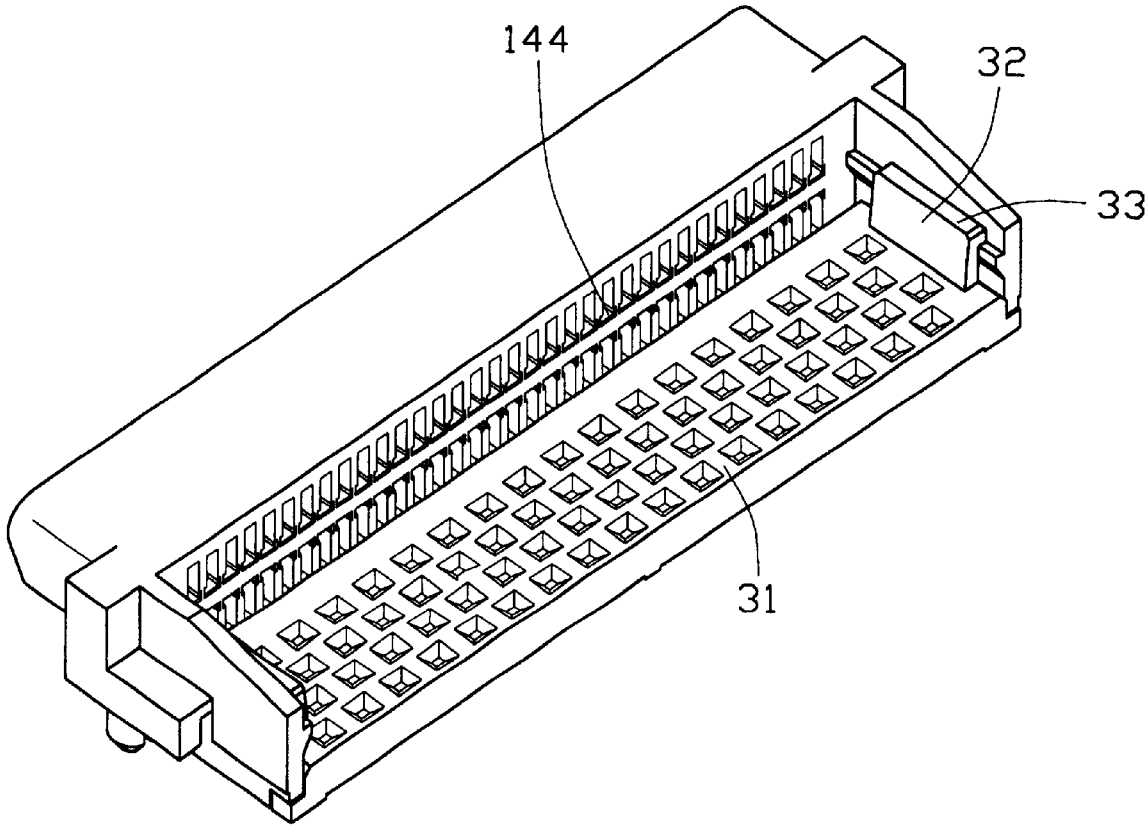
FIG. 3 is similar to FIG. 1, but electrical contacts of the electrical connector have been removed away.
Figure 5:
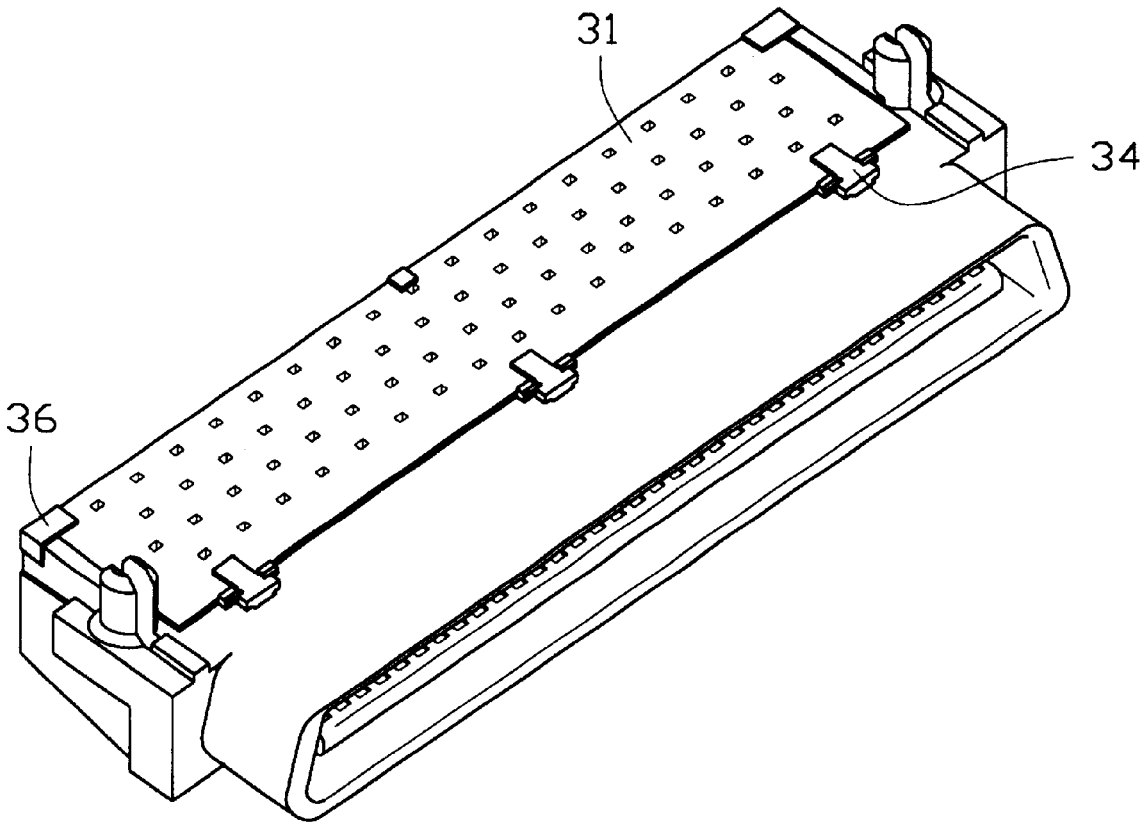
FIG. 5 is an inverse view of FIG. 3.

Referring also to FIGS. 3 and 5, the dielectric spacer 30 comprises an elongated and generally flat plate body 31 and a pair of latches 32 extending upwardly from front portions of opposite longitudinal ends of the plate body 31. The plate body 31 comprises a plurality of through holes 310 extending therethrough, three retainers 34 extending forwardly beyond a front end thereof and a pair of extensions 36 extending outwardly and laterally from lower and rear portions of the opposite longitudinal ends of the plate body 31. Each latch 32 has a hook section 33 extending outwardly at an upper end thereof. Each retainer 34 comprises a body section 37 and a pair of wings 38 extending laterally and outwardly from lower and front sections of opposite sides of the body section 37. The wings 38 are spaced from the plate body 31 by a neck section 35 (best shown in FIG. 7). Each neck section 35 has a pair of barbs 39 protruding laterally therefrom.

In assembly, the contacting portions 22 of the electrical contacts 20 are received in the passageways 144 of the insulative housing 10 to engage with corresponding electrical contacts of a complementary electrical connector (not shown) plugged into the receiving cavity 140 of the mating portion 14. The transitional portions 24 extend rearwardly beyond the rear surface 18 of the mounting portion 12 and are positioned together with the mounting portions 26 in a space defined between the rear surface 18 and the arms 120.

The through holes 310 of the dielectric spacer 30 receive the mounting portions 26 of the electrical contacts 30 to extend therethrough. The hook sections 33 of the latches 32 engage with the step portions 122 of the arms 120 and the extensions 36 extend into the cutouts 124. The body sections 37 of the retainers 34 are pressed into the recesses 126 while the wings 38 abut against the bottom surface of the mounting portion 12 and are stopped from rearwardly moving by the blocks 128. The neck sections 35 are accommodated in rear portions of the recesses 126 between the blocks 128 and the barbs 39 provide a reliable retention therebetween in interference fit fashion.

The engagements between the latches 32 and the step portions 122 and between the extensions 36 and the cutouts 124 prevent vertical movements of the dielectric spacer 30 with respect to the insulative housing 10 while the retainers 34 together with the recesses 126, the blocks 128 and the extensions 36 together with the cutouts 124 prevent the dielectricspacer 30 from horizontal moving with regard to the insulative housing 10. In such a way, the dielectric spacer 30 is reliably retained to the insulative housing 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising a mounting portion defining a front surface, a rear surface opposite to the front surface and a bottom surface, and a mating portion projecting forwardly from the front surface of the mounting portion, the mounting portion comprising a pair of opposite arms extending rearwardly from the rear surface thereof;

a plurality of electrical contacts extending from the mating portion through the mounting portion of the insulative housing and each comprising a mounting portion located in a space between the rear surface and the arms of the mounting portion; and a dielectric spacer defining a plurality of through holes for extension of the mounting portions of the electrical contacts therethrough, the dielectric spacer engaging with the arms and the bottom surface of the mounting portion of the insulative housing;

wherein each arm comprises a step portion in an inward surface thereof, and the dielectric spacer comprises an elongated and generally flat plate body and a pair of latches extending upwardly from the plate body, each latch comprising an outwardly extending hook section engaged with the step portion of the arm;

wherein each arm comprises a cutout and the plate body of the dielectric spacer comprises a pair of extensions mating with the cutouts of the arms;

wherein the mounting portion of the insulative housing comprises a recess at the bottom surface thereof and the plate body of the dielectric spacer comprises a retainer partially received in the recess of the mounting portion;

wherein a pair of blocks are located beside two opposite sides of the recess, respectively, and the retainer comprises a pair of wings to engage with the blocks;

wherein a neck section is defined between the wings of the retainer and the plate body, and the neck section is sandwiched between the blocks;

wherein the neck section comprises a pair of barbs to engage with the blocks.

* * * * *